US006495966B2

(12) United States Patent
Aoki et al.

(10) Patent No.: US 6,495,966 B2
(45) Date of Patent: Dec. 17, 2002

(54) FIELD EMISSION DISPLAY INCLUDING A RESISTOR

(75) Inventors: Masaki Aoki, Osaka (JP); Mitsuhiro Ohtani, Osaka (JP); Shigeo Suzuki, Osaka (JP); Hideki Ashida, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/997,518

(22) Filed: Nov. 29, 2001

(65) Prior Publication Data

US 2002/0074950 A1 Jun. 20, 2002

Related U.S. Application Data

(62) Division of application No. 09/391,999, filed on Sep. 8, 1999.

(51) Int. Cl.[7] ..... H01J 1/62

(52) U.S. Cl. ..... 315/169.1; 313/495; 313/292

(58) Field of Search ..... 313/292–295, 313/495, 309, 422; 315/169.1–169.4

(56) References Cited

U.S. PATENT DOCUMENTS

| | | | | |
|---|---|---|---|---|
| 4,527,147 A | | 7/1985 | Arakawa | 338/162 |
| 4,937,928 A | * | 7/1990 | Van Der Zel | 29/160.6 |
| 5,989,647 A | * | 11/1999 | Remy et al. | 427/446 |
| 6,030,514 A | * | 2/2000 | Dunlop et al. | 204/298.12 |
| 6,342,754 B1 | * | 1/2002 | Kuroda et al. | 313/292 |

FOREIGN PATENT DOCUMENTS

| | | |
|---|---|---|
| GB | 2028576 | 3/1980 |
| GB | 09204109 | 8/1981 |
| JP | 99117578.5 | 8/1997 |

* cited by examiner

*Primary Examiner*—Don Wong
*Assistant Examiner*—Wilson Lee
(74) *Attorney, Agent, or Firm*—Snell & Wilmer; Michael K. Kelly

(57) ABSTRACT

A resistor includes a mixture of at least one of a metal conductive oxide and a transition metal material with an insulating oxide. A method for producing such a resistor includes the steps of forming an electrode on one of an alumina substrate, a glass substrate and a glass tube; and flame-spraying a mixture of at least one of a metal conductive oxide and a transition metal material with an insulating oxide, thereby depositing the mixture on the one of the alumina substrate, the glass substrate and the glass tube.

9 Claims, 8 Drawing Sheets

FIELD EMISSION DISPLAY INCLUDING A RESISTOR

CROSS-REFERENCE TO RELATED APPLICATIONS

This application is a divisional application of U.S. patent application Ser. No. 09/391,999, filed Sep. 8, 1999.

BACKGROUND OF THE INVENTION

1. Field of the Invention:

The present invention relates to a resistor having a high area resistance value usable in an image and video display device utilizing an electron source, for example, a cathode-ray tube (hereinafter, referred to as a "CRT") or a field emission display (hereinafter, referred to as an "FED"), a method for producing such a resistor, a cathode-ray tube including such a resistor, and an FED including such a resistor.

2. Description of the Related Art:

FIG. 6 is a schematic cross-sectional view of a conventional CRT 600 used in a color display apparatus. As shown in FIG. 6, the CRT 600 includes a face plate 601 acting as a fluorescent screen and a neck 602. The neck 602 accommodates a cathode 603 and an electronic lens system 607. The electronic lens system 607 includes a triode section 604 and a main electronic lens section 605 formed of a plurality of metal cylinders 605A and 605B. The electronic lens system 607 is structured so as to project a crossover image of an electronic beam from the cathode section 603 on the face plate 601 using the main electronic lens section 605. Reference numeral 606 represents a built-in division-type resistor.

In the electronic lens system 607 having such a structure, a diameter DS of a spot image on the face plate 601 is found by expression (1) using an electrooptic magnitude M and a spherical aberration coefficient CS0.

$$DS=[(M\times dx+(\tfrac{1}{2})M\times CS0\times\alpha 0^3)^2+DSC^2]^{1/2} \quad (1),$$

where dx is a virtual crossover diameter, α0 is a divergence angle of the beam, and DSC is a divergence component of the beam caused by the repulsive effect of a spatial charge.

Recently, efforts have been made to minimize the spherical aberration coefficient CS0 of the main electronic lens section 605 in order to provide a high precision image by minimizing the spot diameter DS on the face plate 601.

Japanese Laid-Open Publication No. 61-147442, for example, discloses a method for reducing the spherical aberration coefficient CS0 by a built-in division-type resistor. Japanese Laid-Open Publication Nos. 60-208027 and 2-276138, for example, each disclose a method for reducing the spherical aberration coefficient CS0 by forming a convergence electrode of a spiral resistor in the neck of the CRT instead of forming a convergence electrode of the main electronic lens including a plurality of metal cylinders.

The division-type resistor and the spiral resistor are formed in the following manner as described in, for example, Japanese Laid-Open Publication Nos. 61-224402 and 6-275211.

A film is formed of a stable suspension including ruthenium hydroxide ($Ru(OH)_3$) and glass particles and excluding an organic binder. The film is formed on an inner surface of a glass tube (formed of, for example, low melting point lead glass having a softening point of 640° C.) by dipping. The film is dried, and then cut into a spiral pattern. Then, the film is baked at a temperature of 400° C. to 600° C. to form a resistor including ruthenium oxide ($RuO_2$).

Japanese Laid-Open Publication Nos. 61-147442, 55-14627 and 6-275211 disclose another resistor having a high area resistance value, which is formed of $RuO_2$ and high melting point glass particles.

The resistor formed of $RuO_2$ and glass particles is formed in a zigzag pattern on an alumina (e.g., $Al_2O_3$) substrate by screen printing. Such a resistor (referred to as a "glaze resistor") has a total resistance value of 300 MΩ to 1000 MΩ. The alumina used as the substrate has a thermal expansion coefficient of $75\times10^{-7}$/°C. and a melting point of 2,050° C. Since a CRT requires a resistor which is highly reliable against a high voltage of about 30 kV and an electronic beam, the resistor formed of $RuO_2$ and glass particles is formed by baking at a relatively high temperature of 750° C. to 850° C.

Japanese Laid-Open Publication No. 7-309282, for example, discloses still another resistor formed of $RuO_2$ and low melting point glass. The low melting point glass is, for example, PbO—$B_2O_3$—$SiO_2$—based glass and includes PbO at 65% or more by weight. The softening point of the low melting point glass is about 600° C. or less.

The above-described spiral or zigzag-pattern resistors are provided in the neck of the CRT in order to minimize the spot diameter on the fluorescent screen and the deflecting power. In addition, a double anode CRT is also developed in which the electronic lens system includes a high resistance layer in a funnel portion thereof.

A resistor used in the electronic lens system of the CRT provides a potential distribution between the anode electrode and a focus electrode, and thus needs to have a sufficiently high area resistance value of 1 GΩ/□ to 100 GΩ/□ (i.e., about $10^9$ Ω/□ to about $10^{11}$ Ω/□) in order to prevent a current flow sufficiently to avoid sparking and arc discharge.

Displays utilizing an electron source, such as an FED, also require a high area resistance value provided between an anode and a cathode.

According to the method described in Japanese Laid-Open Publication Nos. 61-224402 and 6-275211, $Ru(OH)_3$, which is an insulating substance, is thermally decomposed while being baked at a temperature of 400° C. to 600° C. By such thermal decomposition, $RuO_2$, which is a conductive substance, is deposited, and the low melting point glass flows. As a result, fine particles of $RuO_2$ having a diameter of 0.01 to 0.03 μm are deposited around the glass particles, which form a resistor.

Such a method has the following problems in obtaining a high resistance value of 5 GΩ to 20 GΩ (area resistance value: 1 MΩ/□ to 4 MΩ/□): (i) the dependency of the area resistance value on the baking temperature increases (i.e., the area resistance value significantly changes when the baking temperature slightly changes); (ii) the temperature coefficient of resistance value (TCR) is increased in a negative direction; and (iii) the load characteristic over a long period of time is inferior. The expression "/□" refers to "per unit area".

The method described in Japanese Laid-Open Publication Nos. 55-14527, 61-147442 and 6-275211 has a problem in that the resultant resistor cannot be formed on an inner surface of the low melting point glass (having a softening point of 640° C.) used for the CRT due to the high baking temperature of 750° C. to 850° C.

According to the method described in Japanese Laid-Open Publication No. 7-309282, the resistor can be formed on an inner surface of the CRT at a low temperature of 440° C. to 520° C. However, the resistor formed by this method has problems in that (i) the area resistance value significantly changes in accordance with the load characteristic (against application of a voltage of 30 kV at 70° C. at $10^{-7}$ Torr) in the vacuum over a long period of time (5,000 hours); and (ii) the spot diameter on the fluorescent screen is increased due to the load since the TCR is negative.

A tungsten (W)-aluminium oxide-based cermet resistor having a high area resistance value has been developed for use in the electronic tube (see, for example, Japanese Publication for Opposition No. 56-15712). Such a resistor has problems in that (i) a high area resistance value of $10^9$ Ω/□ or more is not obtained; and (ii) the TCR is negative and the absolute value thereof is excessively large.

A resistor having an area resistance value of 1 GΩ/□ to 100 GΩ/□ does not need to be shaped into a spiral or zigzag pattern, for use in a CRT. However, the conventional resistive materials have an area resistance value of 1 MΩ/□ to 100 MΩ/□. Since such a range of area resistance values is not sufficiently high, the resistor needs to be shaped into a spiral or zigzag pattern.

Attempts have been made to produce an electronic lens system using a high resistance ceramic cylinder without shaping the resistor into a spiral or zigzag pattern (see, for example, Japanese Laid-Open Publication No. 6-275211 and the Proceedings of the 14th International Display Research Conference, pp. 229 to 232 (1994)).

The resistive materials used for this type of electronic lens system include forsterite ($2MgO•SiO_2$)-based and $Al_2O_3$—$MnO_2$—$Fe_2O_3$—$Nb_2O_3$—based materials. The specific resistance value of these materials is $10^{11}$ Ωcm (resistance value: 2.4 GΩ to 240 GΩ). However, it has been pointed out that when the power consumption of a display apparatus, for example, a TV is increased by the negative TCR, the current flowing in the resistive material rapidly increases and possibly thermal runaway occurs.

SUMMARY OF THE INVENTION

According to one aspect of the invention, a resistor includes a mixture of at least one of a metal conductive oxide and a transition metal material with an insulating oxide.

In one embodiment of the invention, the resistor is produced using a flame-spraying method.

In one embodiment of the invention, the flame-spraying method includes plasma flame-spraying.

In one embodiment of the invention, the flame-spraying method includes laser flame-spraying.

In one embodiment of the invention, the metal conductive oxide is at least one material selected from the group consisting of titanium oxide, rhenium oxide, iridium oxide, ruthenium oxide, vanadium oxide, rhodium oxide, osmium oxide, lanthanum titanate, $SrRuO_3$, molybdenum oxide, tungsten oxide, and niobium oxide.

In one embodiment of the invention, the metal conductive oxide is at least one material selected from the group consisting of TiO, $ReO_3$, $IrO_2$, $RuO_2$, VO, $RhO_2$, $OSO_2$, $LaTiO_3$, $SrRuO_3$, $MoO_2$, $WO_2$, and NbO.

In one embodiment of the invention, the transition metal material is at least one material selected from the group consisting of titanium, rhenium, vanadium, and niobium.

In one embodiment of the invention, the insulating oxide is at least one material selected from the group consisting of alumina, silicon oxide, zirconium oxide, and magnesium oxide.

In one embodiment of the invention, the insulating oxide is at least one material selected from the group consisting of $Al_2O_3$, $SiO_2$, $ZrO_2$, and MgO.

In one embodiment of the invention, the metal conductive oxide is TiO, and the insulating oxide is $Al_2O_3$.

In one embodiment of the invention, the resistor has an area resistance value of at least of about 1 GΩ/□.

According to another aspect of the invention, a cathode ray tube includes the above-described resistor.

According to still another aspect of the invention, a method for producing a resistor includes the steps of forming an electrode on one of an alumina substrate, a glass substrate and a glass tube; and flame-spraying a mixture of at least one of a metal conductive oxide and a transition metal material with an insulating oxide, thereby depositing the mixture on the one of the alumina substrate, the glass substrate and the glass tube.

According to still another aspect of the invention, a field emission display includes an anode, a cathode, and a resistor provided between the anode and the cathode. The resistor includes a mixture of at least one of a metal conductive oxide and a transition metal material with an insulating oxide. The resistor is formed using a flame-spraying method. The resistor has an area resistance value of at least about 1 GΩ/□.

In one embodiment of the invention, the field emission display further includes a support provided between the anode and the cathode, wherein the support is covered with the resistor.

In one embodiment of the invention, the support includes at least one of glass and alumina.

In one embodiment of the invention, the metal conductive oxide is at least one material selected from the group consisting of titanium oxide, rhenium oxide, iridium oxide, ruthenium oxide, vanadium oxide, rhodium oxide, osmium oxide, lanthanum titanate, $SrRuO_3$, molybdenum oxide, tungsten oxide, and niobium oxide.

In one embodiment of the invention, the metal conductive oxide is at least one material selected from the group consisting of TiO, $ReO_3$, $IrO_2$, $RuO_2$, VO, $RhO_2$, $OsO_2$, $LaTiO_3$, $SrRuO_3$, $MoO_2$, $WO_2$, and NbO.

In one embodiment of the invention, the transition metal material is at least one material selected from the group consisting of titanium, rhenium, vanadium, and niobium.

In one embodiment of the invention, the insulating oxide is at least one material selected from the group consisting of alumina, silicon oxide, zirconium oxide, and magnesium oxide.

In one embodiment of the invention, the insulating oxide is at least one material selected from the group consisting of $Al_2O_3$, $SiO_2$, $ZrO_2$, and MgO.

In one embodiment of the invention, the metal conductive oxide is TiO, and the insulating oxide is $Al_2O_3$.

According to the present invention, a resistor having a satisfactorily high area resistance value, a satisfactory load characteristic in vacuum, and a positive and stable TCR is obtained without a baking process.

Such a resistor is obtained by flame-spraying a mixture of both or either of a metal conductive oxide or a transition metal material and an insulating oxide toward a substrate using plasma torch or laser. Usable metal conductive oxides include, for example, TiO, $ReO_3$, $IrO_2$, $MoO_2$, $WO_2$, $RuO_2$, and $LaTiO_2$. Usable transition metal materials include, for example, Ti, Re, V and Nb. Usable insulating oxides include, for example, $SiO_2$, $Al_2O_3$, $ZrO_2$, and MgO.

Since the particles of the metal conductive oxide or the transition metal material are dispersed among the particles of the insulating oxide, the resistor formed of the above-described mixture has a sufficiently high area resistance value.

The present inventors have found that (i) by using an appropriate metal conductive oxide and/or transition metal material and insulating oxide at an appropriate ratio and an appropriate flame-spraying method, a resistor having a high area resistance value of about 1 GΩ/□ to about 100 GΩ/□ is produced; (ii) the resultant resistor has a superior overtime load characteristic to the conventional resistors; and (iii) the TCR of the resultant resistor is small and stable.

Such a resistor does not need to be shaped into a spiral or zigzag pattern and can be easily formed on an alumina substrate of an inner surface of the funnel of a CRT.

Thus, the invention described herein makes possible the advantages of providing (1) a resistor having a satisfactorily high area resistance value produced without baking; (2) a resistor having a satisfactorily high load characteristic over a long period of time in vacuum; (3) a reliable resistor having a small TCR; (4) a method for producing such a resistor; (5) a CRT including such a resistor; and (6) an FED including such a resistor.

These and other advantages of the present invention will become apparent to those skilled in the art upon reading and understanding the following detailed description with reference to the accompanying figures.

DESCRIPTION OF THE EMBODIMENTS

Hereinafter, the present invention will be described by way of illustrative examples with reference to the accompanying drawings.

EXAMPLE 1

A resistor produced by a plasma flame-spraying method in a first example according to the present invention will be described with reference to FIGS. 1A, 1B and 2.

Figure 1A:
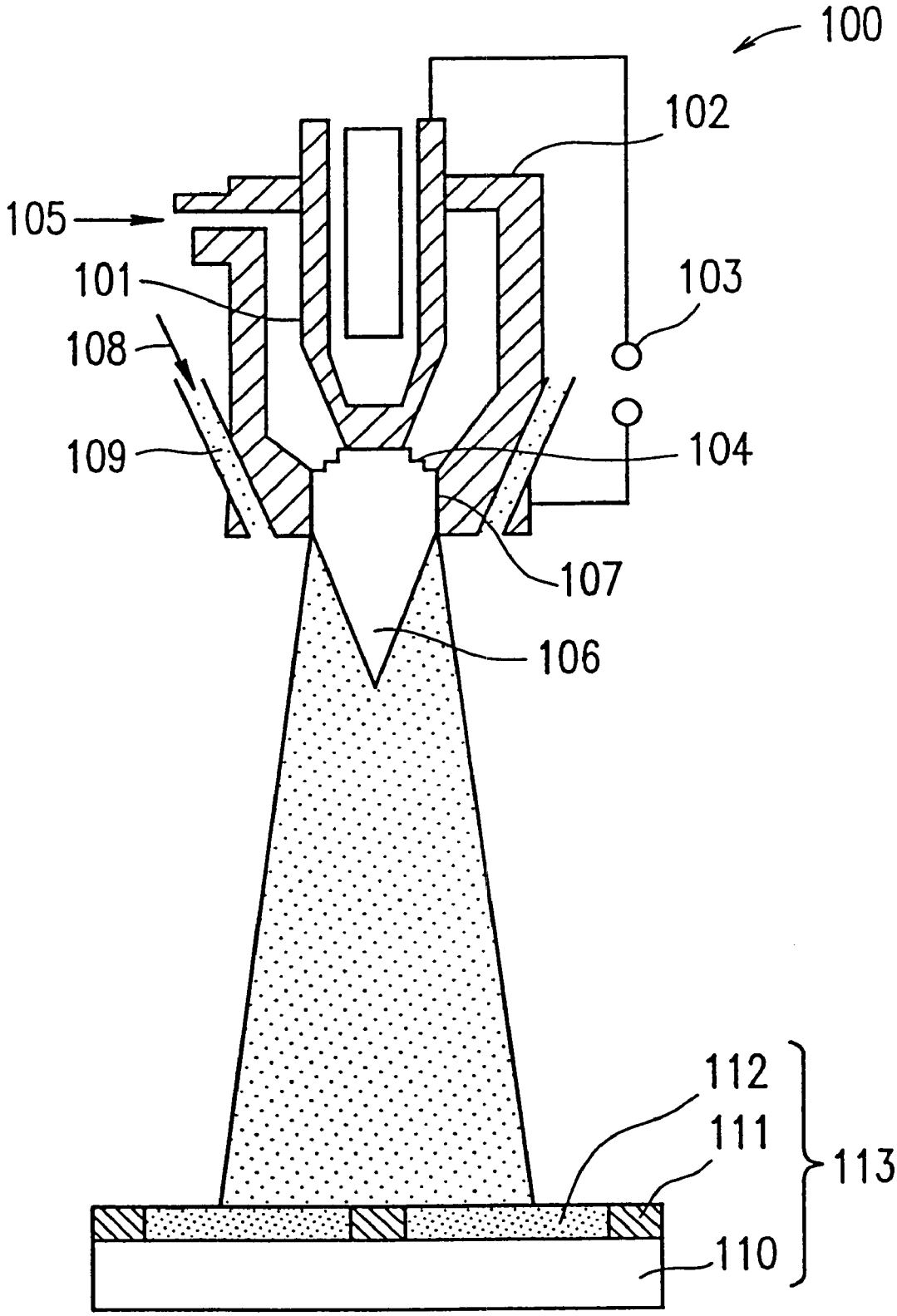
FIG. 1A is a schematic view of a plasma flame-spraying apparatus used for producing a resistor in a first example according to the present invention.

FIG. 1A is a schematic view of a plasma flame-spraying apparatus 100 used for producing a resistor in the first example. FIG. 1B is a flowchart illustrating a method for producing the resistor in the first example.

As shown in FIG. 1A, the plasma flame-spraying apparatus 100 includes a negative electrode 101, a positive electrode 102, a power supply 103, a spray nozzle 107, and a powder supply port 109 for supplying a resistive material 108. Reference numeral 104 represents a DC arc, and reference numeral 105 represents operation gas. Reference numeral 106 represents an arc plasma jet 106. Reference numeral 110 represents an alumina (e.g., $Al_2O_3$) substrate, and reference numeral 111 represents an electrode (for example, focus electrode and anode electrode). Reference numeral 112 represents a resistor produced by the plasma flame-spraying apparatus 100. A glass substrate maybe used instead of the alumina substrate 110.

Figure 1B:
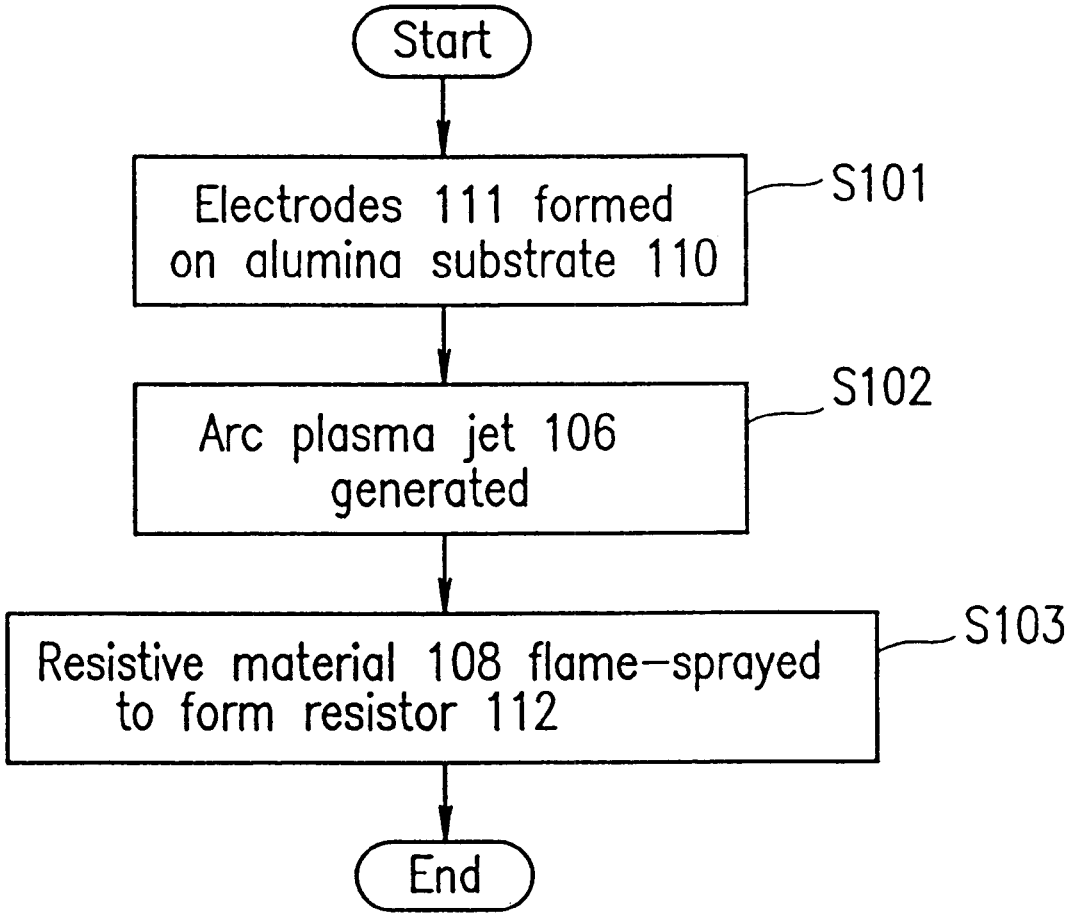
FIG. 1B is a flowchart illustrating a method for producing the resistor shown in FIG. 1A.

With reference to FIG. 1B, a method for producing the resistor 112 will be described. Refer to FIG. 1A for the reference numeral of each element.

In step S101, a silver paste, for example, is screen-printed on the alumina substrate 110 and then baked, thereby forming the electrodes 111.

Then, in step S102, an electric field is applied between the negative electrode 101 and the positive electrode 102 using the power supply 103 to generate the DC arc 104. The operation gas 105 (e.g., argon-hydrogen mixture gas or nitrogen-hydrogen mixture gas) is caused to flow along a surface of the negative electrode 101 to generate the arc plasma jet 106.

In step S103, the resistive material 108 including, for example, a mixture powder including TiO at about 30% by weight and $Al_2O_3$ at about 70% by weight is supplied from the powder supply port 109. While the spray nozzle 107 is moved toward the alumina substrate 110 to a thickness of about 20 μm, thereby forming the resistor 112 on the alumina substrate 110. In the case where the resistive material 108 needs to be flame-sprayed under a low pressure atmosphere of about 0.1 to about 10 Torr, the plasma flame-spraying apparatus 100 is entirely accommodated in a low pressure chamber before the production.

Then, $Al_2O_3$ is sprayed toward the resistor 112 to a thickness of about 40 μm, thereby forming a protective film (not shown). $Al_2O_3$ is not sprayed to the electrodes 111. Thus, a resistor section 113 including the TiO—$Al_2O_3$ —based resistor 112, the alumina substrate 110 and the electrodes 111 is formed.

The TiO—$Al_2O_3$—based resistor 112, which is produced without a baking process, has a high area resistance value of about 1 GΩ/□ or more and also a satisfactory heat-resistant load characteristic as described below. Furthermore, the TiO—$Al_2O_3$—based resistor 112 has a positive and stable TCR.

Figure 2:
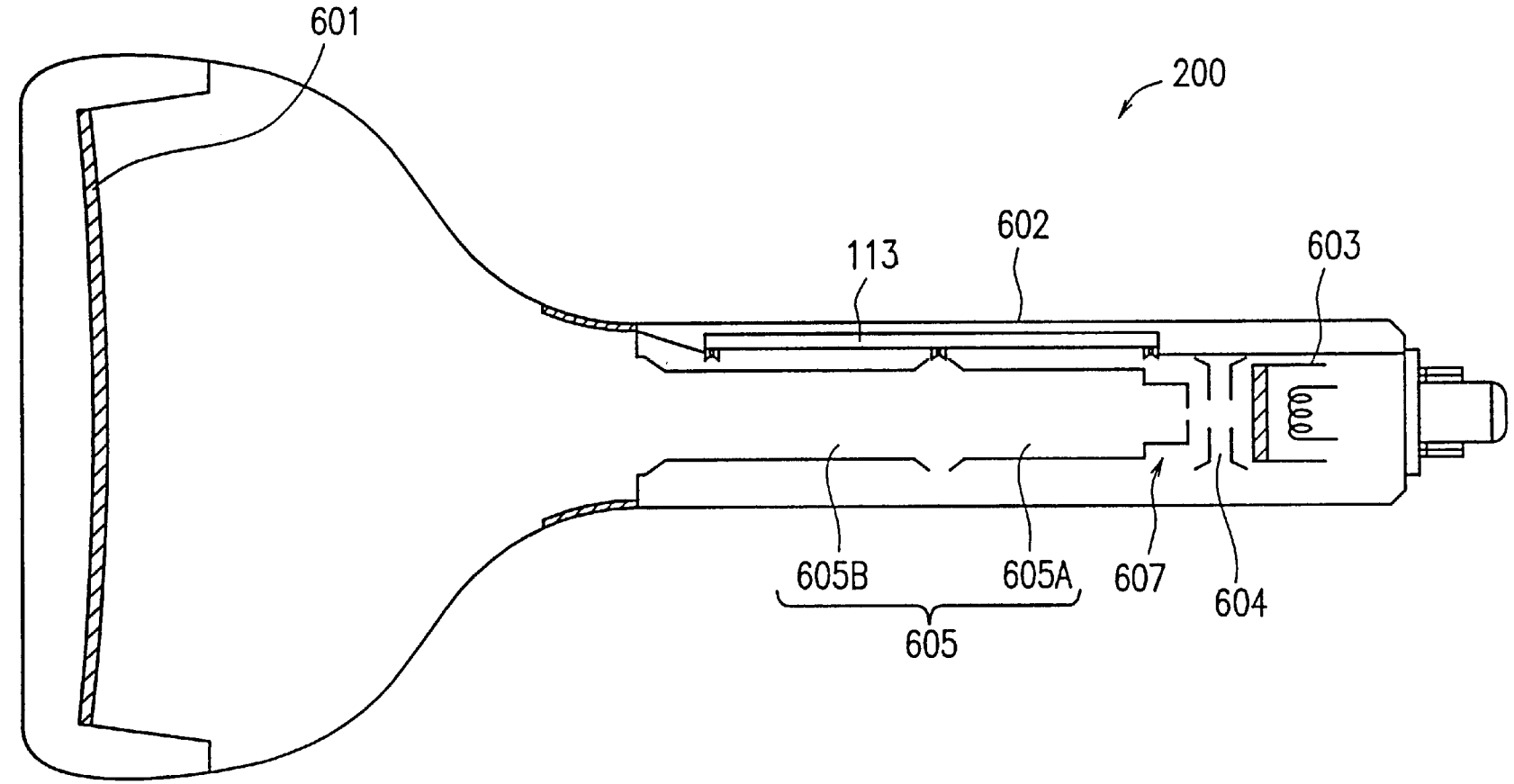
FIG. 2 is a schematic cross-sectional view of a CRT including the resistor shown in FIG. 1A.
Figure 6:
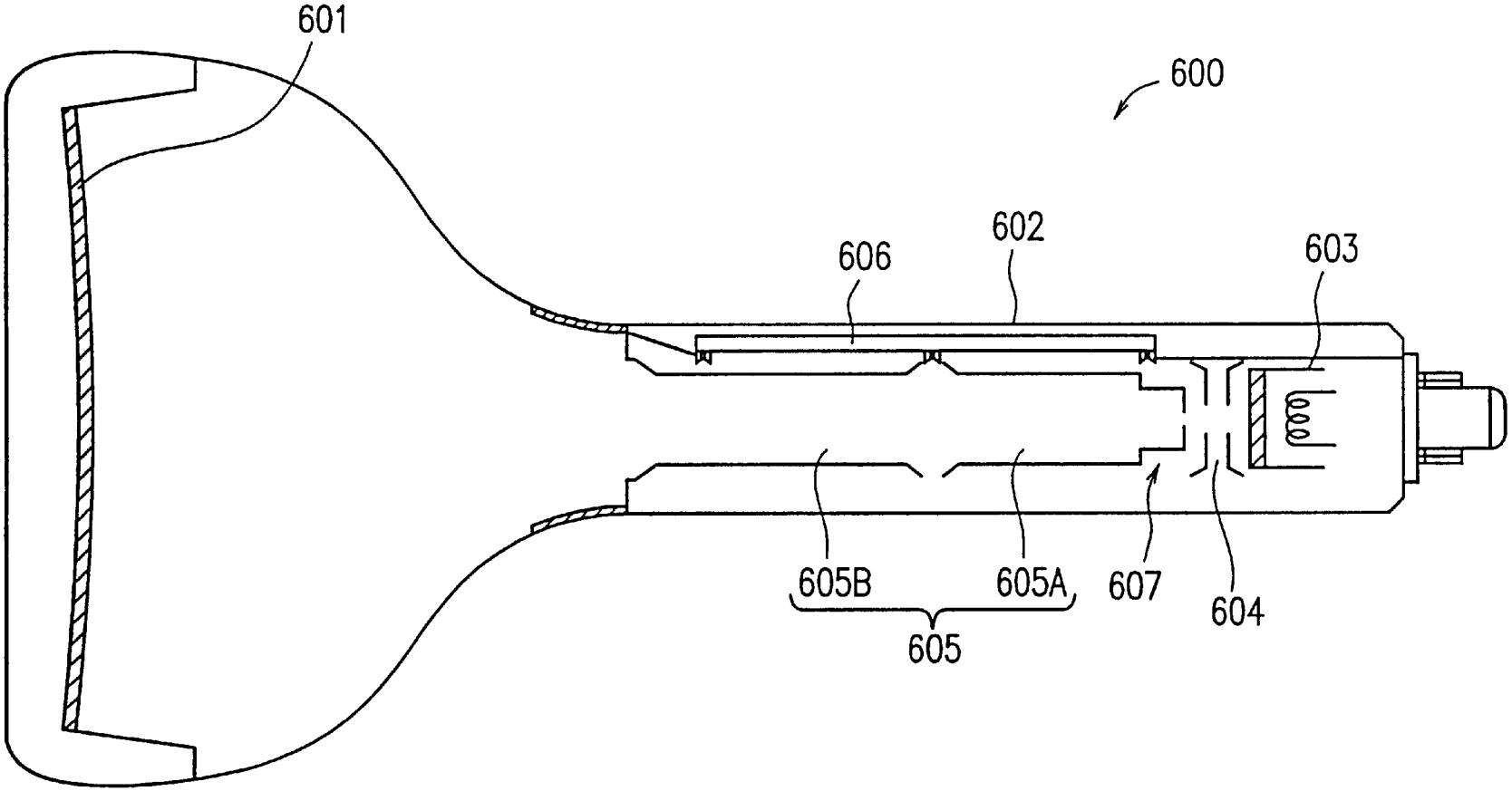
FIG. 6 is a schematic cross-sectional view of a conventional CRT.

FIG. 2 is a schematic cross-sectional view of a CRT 200 including the resistor section 113. Identical elements previously discussed with respect to FIG. 6 bear identical reference numerals and the descriptions thereof will be omitted.

The resistor section 113, as described above with reference to FIG. 1A, includes the TiO—$Al_2O_3$—based resistor 112, the alumina substrate 110 and the electrodes 111.

The CRT 200 including the TiO—$Al_2O_3$—based resistor 112 enjoys the above-described advantages of the TiO—$Al_2O_3$—based resistor 112.

The present invention is not limited to the TiO—$Al_2O_3$—based resistor 112. Usable instead of TiO are both or either of a metal conductive oxide or a transition metal material. Usable instead of $Al_2O_3$ is an insulating oxide.

EXAMPLE 2

A resistor produced by a laser flame-spraying method in a second example according to the present invention will be described with reference to FIGS. 3A, 3B and 4.

Figure 3A:
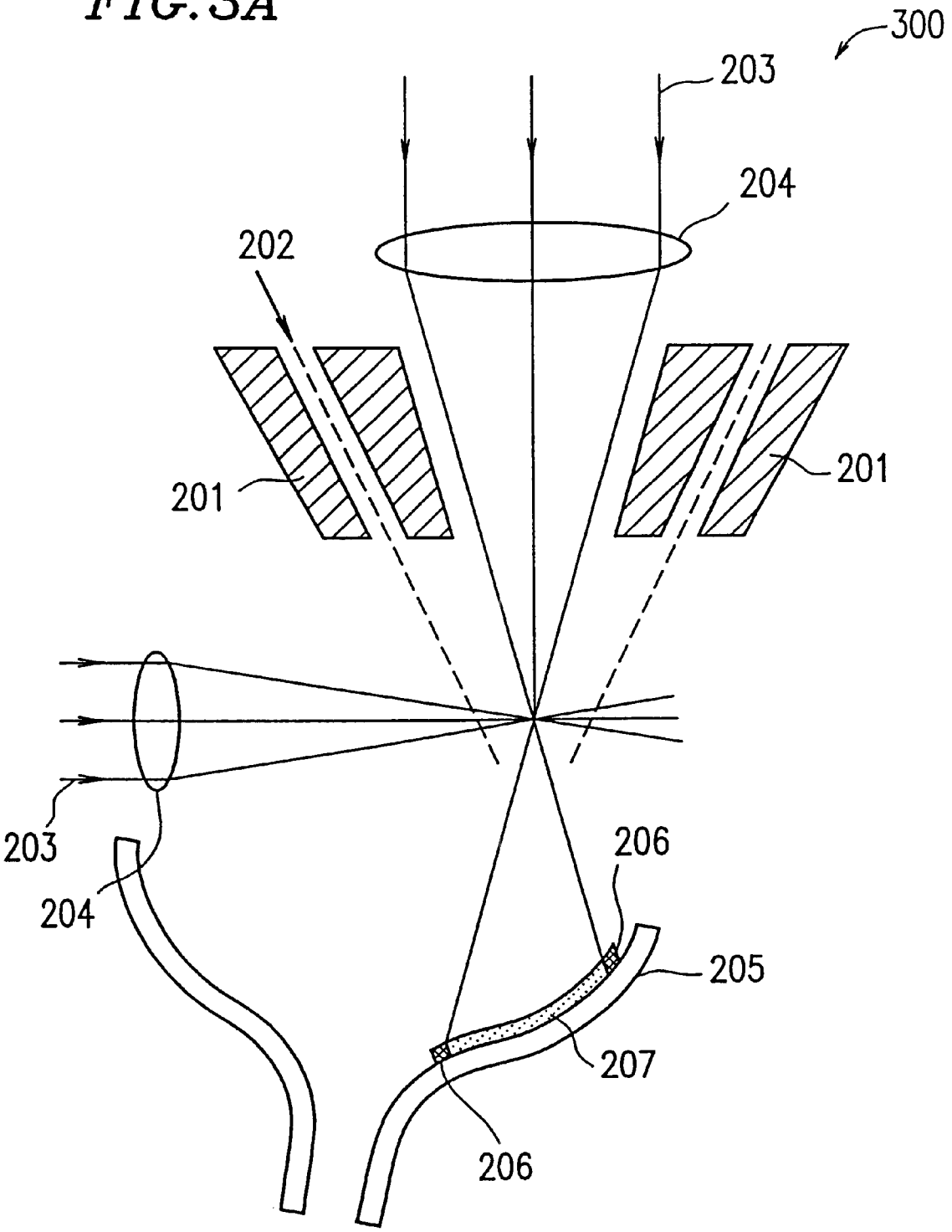
FIG. 3A is a schematic view of a laser flame-spraying apparatus used for producing a resistor in a second example according to the present invention.

FIG. 3A is a schematic view of a laser flame-spraying apparatus 300 used for producing a resistor in the second example. FIG. 3B is a flowchart illustrating a method for producing the resistor in the second example.

As shown in FIG. 3A, the laser flame-spraying apparatus 300 includes a spray nozzle 201, a powder supply port 202 for supplying a resistive material (not shown), and a laser light collection lens system 204. The powder supply port 202 is formed so as to run throughout the spray nozzle 201. Reference numeral 203 represents laser light. Reference numeral 205 represents a glass tube of a CRT, and reference numeral 206 represents an electrode. Reference numeral 207 represents a resistor produced by the laser flame-spraying apparatus 300.

Figure 3B:
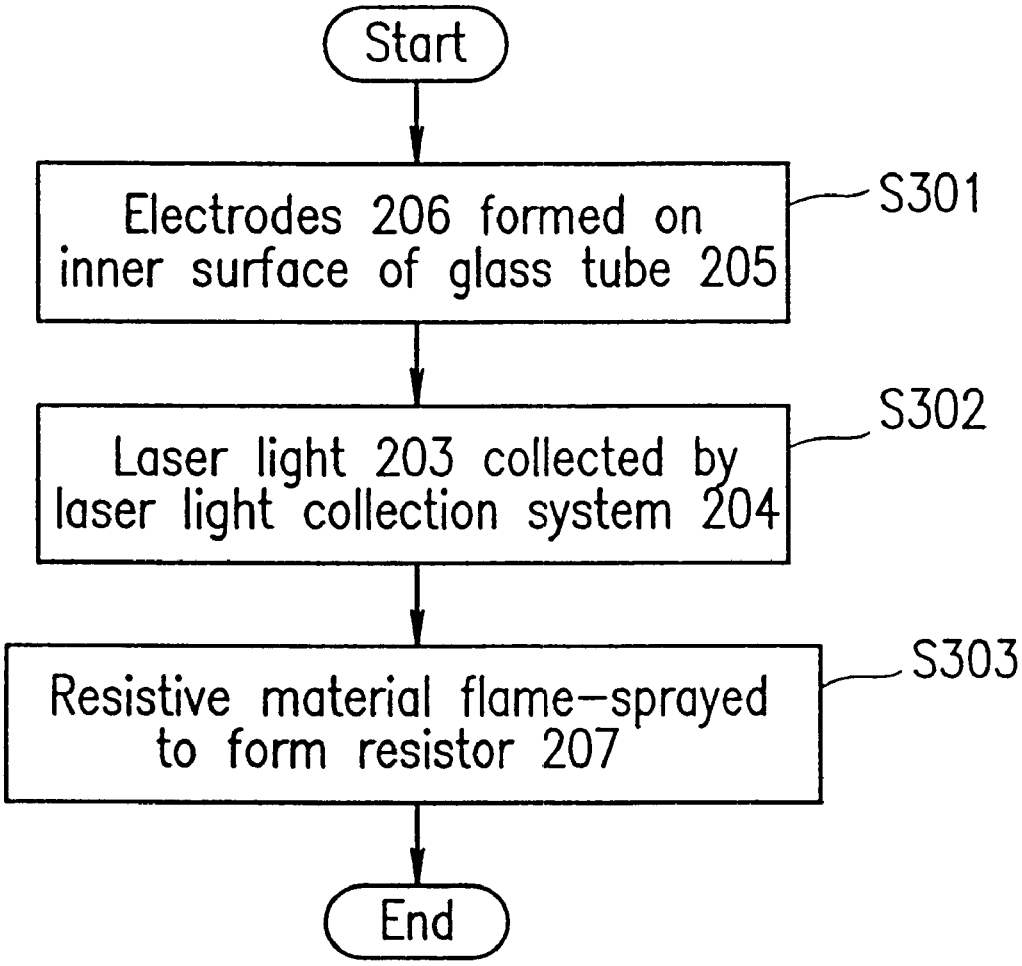
FIG. 3B is a flowchart illustrating a method for producing the resistor shown in FIG. 3A.

With reference to FIG. 3B, a method for producing the resistor 207 will be described. Refer to FIG. 3A for the reference numeral of each element.

In step S301, the electrodes 206 (for example, anode electrode and focus electrode) are formed on an inner surface of the glass tube 205 of the CRT. The electrodes 206 can be formed of the same material and in the same manner as those of the electrodes 111 described in the first example.

Then, in step S302, the laser light 203 is collected by the laser light collection lens system 204. Instep S303, a resistive material (not shown) including, for example, a mixture powder including TiO at about 10% by weight and $Al_2O_3$ at about 90% by weight is supplied from the power supply port 202. While the spray nozzle 201 is moved toward the glass tube 205, the resistive material is flame-sprayed toward the glass tube 205 to a thickness of about 20 $\mu$m, thereby forming resistor 207 on the glass tube 205. Since the resistor 207 is formed on the inner surface of the glass tube 205, it is not necessary to form a protective film as is necessary in the first example.

The TiO—$Al_2O_3$—based resistor 207, which is produced without a baking process, has a high resistance value of about 1 GΩ and also a satisfactory heat-resistant load characteristic as described below. Furthermore, the TiO—$Al_2O_3$—based resistor 207 has a positive and stable TCR.

Figure 4:
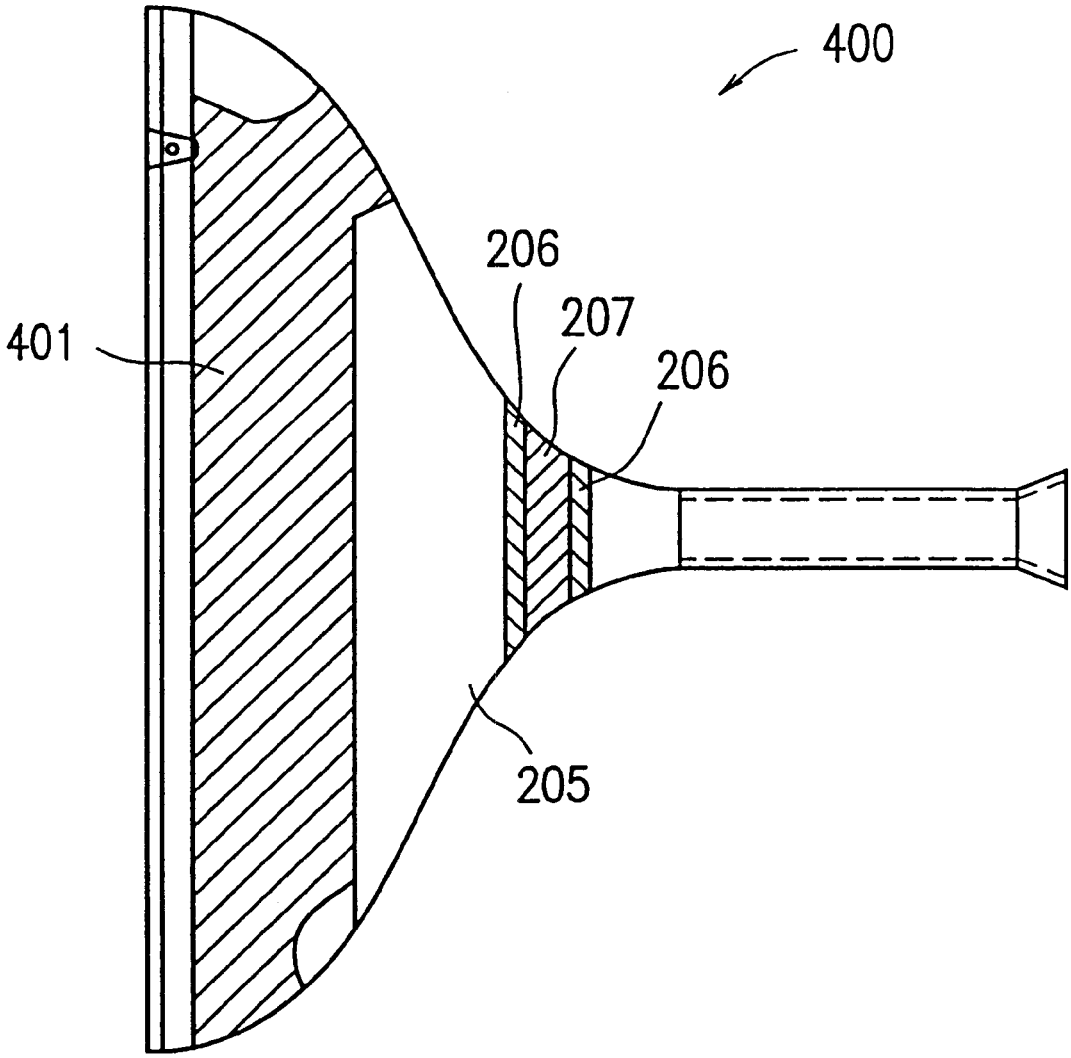
FIG. 4 is a schematic cross-sectional view of a CRT including the resistor shown in FIG. 3A.

FIG. 4 is a schematic cross-sectional view of a CRT 400 including the TiO—$Al_2O_3$—based resistor 207.

The CRT 400 includes the TiO—$Al_2O_3$—based resistor 207 provided on the inner surface of the glass tube 205, and the electrodes 206. An inner surface 401 of the CRT 400 is coated with a paste of graphite, $RuO_2$ or the like.

The CRT 400 including the TiO—$Al_2O_3$—based resistor 207 enjoys the above-described advantages of the TiO—$Al_2O_3$—based resistor 207.

The present invention is not limited to the TiO—$Al_2O_3$—based resistor 207. Usable instead of TiO are both or either of a metal conductive oxide or a transition metal material. Usable instead of $Al_2O_3$ is an insulating oxide.

EXAMPLE 3

In a third example, an FED 500 including a resistor according the present invention will be described with reference to FIGS. 5A and 5B.

Figure 5A:
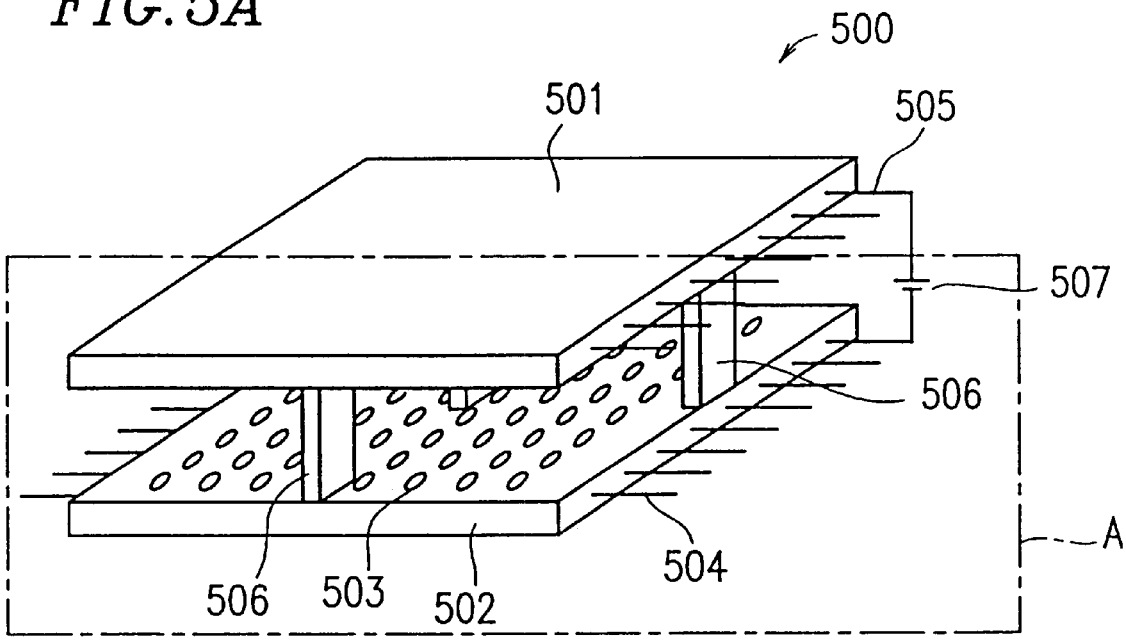
FIG. 5A is an isometric view of an FED in a third example according to the present invention.

FIG. 5A is an isometric view of the FED 500. FIG. 5B is a cross-sectional view of the FED 500 taken along surface A in FIG. 5A.

Figure 5B:
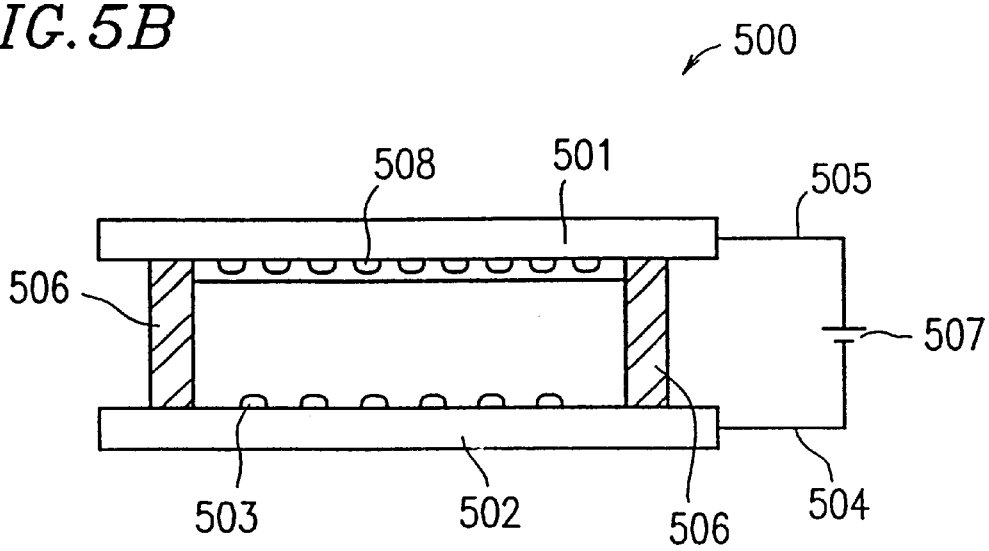
FIG. 5B is a cross-sectional view of the FED shown in FIG. 5A taken along surface A.

As shown in FIGS. 5A and 5B, the FED 500 includes an anode 501, a cathode 502, an FED array 503 provided on an inner surface of the cathode 502, a cathode drawing electrode 504 connected to the cathode 502, an anode drawing electrode 505 connected to the anode 501, a fluorescent body 508 provided on an inner surface of the anode 501, and a power supply 507.

Supports 506 are provided between the anode 501 and the cathode 502 for preventing the anode 501 and the cathode 502 from contacting each other in vacuum. The supports 506 are formed of glass, alumina or any other insulating material.

The supports 506 are covered with the TiO—$Al_2O_3$—based resistor 112 described in the first example or the TiO—$Al_2O_3$—based resistor 207 in the second example.

Without such a resistor, the following inconvenience occurs. When a high voltage of several kilovolts to several tens of kilovolts is applied between the anode drawing electrode 504 and the cathode drawing electrode 505, electrons are accumulated in the supports 506 since the supports 506 are formed of an insulating material. When the electrons are accumulated in the supports 506, arc or spark is generated from the supports 506. As a result, an image on a screen of the FED 500 is disturbed or the fluorescent body 508 is damaged.

In the FED 500 including the above-described resistor, the electrons accumulated in the supports 506 are removed by causing a slight amount of current to flow in the supports 506. Accordingly, the electrons are not accumulated, which prevents generation of arc or spark from the supports 506 or damages on the fluorescent body 508.

SPECIFIC EXAMPLES

TiO and $Al_2O_3$-based resistors are produced with various ratios of TiO and $Al_2O_3$. Resistors including both or either of a metal conductive oxide or a transition metal material (e.g., $ReO_3$, $IrO_2$, $MoO_2$, $WO_2$, $RuO_2$, $LaTiO_3$, or $TiO_{2-x}$ ($0<x<1$)), and an insulating oxide (e.g., $SiO_2$, $ZrO_2$, or MgO) are also produced with various ratios.

The resistors are produced by a plasma flame-spraying method or a laser flame-spraying method.

The resultant resistors are each attached to an electronic gun of the CRT 200 (FIG. 2) or the CRT 400 (FIG. 4), or provided on the supports 506 of the FED 500 (FIGS. 5A and 5B).

An accelerated test of the CRT 200 can be performed by applying a voltage of about 30 kV to about 40 kV to the anode electrode (e.g., electrode 111 in FIG. 1A) and applying a voltage of about 5 kV to about 10 kV to the focus electrode (e.g., electrode 111 in FIG. 1A). In this example, a voltage of about 30 kV is applied to the anode electrode for about 5,000 hours for testing the life of the CRT 200 (test of actual life). A voltage of about 45 kV is applied to the anode electrode for about 10 hours for testing the life of the CRT 200 when an excessive load is applied (test of life against short-time application of excessive load).

An accelerated test of the CRT 400 can be performed by applying a voltage of about 10 kV to about 30 kV between the electrodes 206. In this example, a voltage of about 30 kV is applied between the electrodes 206 for about 5,000 hours for testing the life of the CRT 400 (test of actual life). A voltage of about 45 kV is applied to the anode between the electrodes 206 for about 10 hours for testing the life of the CRT 400 when an excessive load is applied (test of life against short-time application of excessive load).

An accelerated test of the FED 500 is performed by applying a voltage of about 15 kV between the anode drawing electrode 504 and the cathode drawing electrode 505. An area resistance value, temperature characteristic of resistance value (TCR), and overtime change in the area resistance value, and the like are evaluated.

The conditions for producing the resistors are shown in Tables 1 through 4. The evaluation results are shown in Tables 5 and 6. Samples 15 through 19 in Table 2 are conventional resistors.

TABLE 1

| Sample | Materials and ratio (% by weight) Metal conductive oxide | | Insulating oxide | | Method for film formation | Substrate | Use | Pattern of resistor |
|---|---|---|---|---|---|---|---|---|
| 1 | TiO | (30) | $Al_2O_3$ | (70) | Plasma flame-spraying spraying ($Ar—H_2$ gas) | Alumina ($Al_2O_3$) | Division-type resistor | Plain |
| 2 | TiO | (5) | $Al_2O_3$ | (95) | Plasma flame-spraying ($N_2—H_2$ gas) | Alumina ($Al_2O_3$) | Division-type resistor | Plain |
| 3 | TiO | (3) | $Al_2O_3$ | (97) | Laser flame-spraying | Alumina ($Al_2O_3$) | Division-type resistor | Plain |
| 4 | $ReO_3$ | (5) | $SiO_2$ | (95) | Laser flame-spraying | Alumina ($Al_2O_3$) | Division-type resistor | Plain |
| 5 | $IrO_2$ | (5) | $ZrO_2$ | (95) | Plasma flame-spraying ($N_2—H_2$ gas) | Alumina ($Al_2O_3$) | Division-type resistor | Plain |
| 6 | $RuO_2$ | (3) | MgO | (97) | Plasma flame-spraying ($Ar—H_2$ gas) | Alumina ($Al_2O_3$) | Division-type resistor | Plain |
| 7 | VO | (5) | $Al_2O_3$ | (95) | Plasma flame-spraying ($Ar—H_2$ gas) | Alumina ($Al_2O_3$) | Division-type resistor | Plain |
| 8 | $RhO_2$ | (4) | $Al_2O_3$ | (96) | Laser flame-spraying | CRT glass tube | Inner surface of CRT | Plain |
| 9 | $LaTiO_3$ | (5) | $Al_2O_3$ | (95) | Plasma flame-spraying ($N_2—H_2$ gas) | CRT glass tube | Inner surface of CRT | Plain |
| 10 | $SrRuO_3$ | (5) | $Al_2O_3$ | (95) | Plasma flame-spraying ($N_2—H_2$ gas) | CRT glass tube | Inner surface of CRT | Plain |

TABLE 2

| Sample | Materials and ratio (% by weight) Metal conductive oxide (except for samples 17, 18 and 19) | | Insulating oxide | | Method for film formation | Substrate | Use | Pattern of resistor |
|---|---|---|---|---|---|---|---|---|
| 11 | $MoO_2$ | (5) | $Al_2O_3$ | (95) | Plasma flame-spraying ($N_2—H_2$ gas) | Alumina ($Al_2O_3$) | Division-type resistor | Plain |
| 12 | $WO_2$ | (5) | $Al_2O_3$ | (95) | Plasma flame-spraying ($N_2—H_2$ gas) | Alumina ($Al_2O_3$) | Division-type resistor | Plain |
| 13 | NbO | (5) | $SiO_2$ | (95) | Plasma flame-spraying ($N_2—H_2$ gas) | Alumina ($Al_2O_3$) | Division-type resistor | Plain |
| 14 | $OsO_2$ | (5) | $SiO_2$ | (95) | Plasma flame-spraying ($N_2—H_2$ gas) | Alumina ($Al_2O_3$) | Division-type resistor | Plain |
| 15* | $RuO_2$ | (3) | Lead-based glass ($PbO—SiO_2—B_2O_3—Al_2O_3$) | (97) | Paste is screen-printed and baked at 800° C. | Alumina ($Al_2O_3$) | Division-type resistor | Zigzag |
| 16* | $RuO_2$ | (3) | Lead-based glass ($PbO—SiO_2—B_2O_3—Al_2O_3$) | (97) | Paste is screen-printed and baked at 450° C. | CRT glass tube | Inner surface of CRT | Zigzag |
| 17* | $Al_2O_3—MnO_2—Fe_2O_3—Nb_2O_3$-based ceramic | | | | Baked | Cylinder in CRT | | Zigzag |
| 18* | W | (20) | $Al_2O_3$ | (80) | Sputtered and baked at 850° C. in vacuum | Alumina ($Al_2O_3$) | Division-type resistor | Plain |
| 19* | Mo | (20) | $Al_2O_3$ | (80) | Sputtered and baked at 850° C. in vacuum | Alumina ($Al_2O_3$) | Division-type resistor | Plain |

*Samples 15 through 19: conventional resistors

TABLE 3

| Sample | Materials and ratio (% by weight) Metal conductive oxide or transition metal material | | Insulating oxide | | Method for film formation | Substrate | Use | Pattern of resistor |
|---|---|---|---|---|---|---|---|---|
| 20 | TiO | (10) | $Al_2O_3$ | (90) | Plasma flame-spraying ($Ar—H_2$ gas) | Glass support in FED | Charge prevention (Arc and spark prevention) | Plain |
| 21 | $TiO_{1.5}$ | (5) | $Al_2O_3$ | (95) | Plasma flame-spraying ($N_2—H_2$ gas) | Glass support in FED | Charge prevention (Arc and spark prevention) | Plain |
| 22 | $TiO_{1.2}$ | (3) | $Al_2O_3$ | (97) | Laser flame-spraying | Glass support in FED | Charge prevention (Arc and spark prevention) | Plain |
| 23 | $ReO_3$ | (5) | $SiO_2$ | (95) | Laser flame-spraying | Glass support in FED | Charge prevention (Arc and spark prevention) | Plain |
| 24 | $IrO_2$ | (5) | $ZrO_2$ | (95) | Plasma flame-spraying ($N_2—H_2$ gas) | Glass support in FED | Charge prevention (Arc and spark prevention) | Plain |

TABLE 3-continued

| Sample | Materials and ratio (% by weight): Metal conductive oxide or transition metal material | | Insulating oxide | | Method for film formation | Substrate | Use | Pattern of resistor |
|---|---|---|---|---|---|---|---|---|
| 25 | $RuO_2$ | (5) | MgO | (95) | Plasma flame-spraying ($Ar—H_2$ gas) | Glass support in FED | Charge prevention (Arc and spark prevention) | Plain |
| 26 | VO | (10) | $Al_2O_3$ | (90) | Plasma flame-spraying ($Ar—H_2$ gas) | Glass support in FED | Charge prevention (Arc and spark prevention) | Plain |

TABLE 4

| Sample | Materials and ratio (% by weight): Metal conductive oxide or transition metal material | | Insulating oxide | | Method for film formation | Substrate | Use | Pattern resistor |
|---|---|---|---|---|---|---|---|---|
| 27 | $RhO_2$ | (5) | $Al_2O_3$ | (95) | Laser flame-spraying | CRT glass tube | Inner surface of CRT | Plain |
| 28 | Ti | (5) | $Al_2O_3$ | (95) | Plasma flame-spraying ($N_2—H_2$ gas) | CRT glass tube | Inner surface of CRT | Plain |
| 29 | Re | (5) | $Al_2O_3$ | (95) | Plasma flame-spraying ($N_2—H_2$ gas) | CRT glass tube | Inner surface of CRT | Plain |
| 30 | V | (5) | $Al_2O_3$ | (95) | Plasma flame-spraying ($N_2—H_2$ gas) | Glass support in FED | Charge prevention (Arc and spark prevention) | Plain |
| 31 | Nb | (5) | $Al_2O_3$ | (95) | Plasma flame-spraying ($N_2—H_2$ gas) | Glass support in FED | Charge prevention (Arc and spark prevention) | Plain |

TABLE 5

| Sample | Thickness | Area resistance value | Temperature characteristic of resistance value (TCR) (PPm/° C.) | $10^{-7}$ Torr 70° C. 30 kV: change in area resistance value after 5000 hrs. | 45 kV: change in area resistance value after 10 hrs. |
|---|---|---|---|---|---|
| 1 | 20 μm | 1 GΩ | −150 | 0.3% | −0.5% |
| 2 | 20 μm | 10 GΩ | −350 | 0.25% | −0.5% |
| 3 | 35 μm | 100 GΩ | −300 | 0.2% | −0.6% |
| 4 | 40 μm | 15 GΩ | +1500 | 0.5% | −0.7% |
| 5 | 30 μm | 50 GΩ | +1500 | 0.3% | −0.8% |
| 6 | 30 μm | 1 GΩ | +35 | 0.3% | −0.7% |
| 7 | 30 μm | 5 GΩ | −45 | 0.5% | −1.2% |
| 8 | 30 μm | 3 GΩ | +200 | 0.4% | −1.0% |
| 9 | 30 μm | 10 GΩ | −30 | 0.5% | −1.5% |
| 10 | 30 μm | 4 GΩ | −55 | 0.3% | −1.3% |
| 11 | 30 μm | 1 GΩ | −20 | −0.8% | −1.2% |
| 12 | 30 μm | 2 GΩ | −35 | −0.7% | −1.5% |
| 13 | 30 μm | 10 GΩ | −18 | −0.5% | −1.0% |
| 14 | 30 μm | 3 GΩ | +1500 | +0.8% | −0.8% |
| 15 | 5 μm | 1 GΩ | +340 | −1.2% | −15% |
| 16 | 5 μm | 10 GΩ | +420 | −1.5% | −20% |

TABLE 6

| Sample | Thickness | Area resistance value | Temperature characteristic of resistance value (TCR) (PPm/° C.) | $10^{-7}$ Torr 70° C. 30 kV: change in area resistance value after 5000 hrs. | 45 kV: change in area resistance value after 10 hrs. |
|---|---|---|---|---|---|
| 17 | 5 μm | 100 GΩ | +1500 | 5.2% | −15% |
| 18 | 5 μm | 1 GΩ | +11000 | −15% | Cracks in substrate |
| 19 | 5 μm | 2 GΩ | +10000 | −19% | Cracks in substrate |
| 20 | 20 μm | 8 GΩ | +50 | 0.3% | −0.6% |
| 21 | 20 μm | 10 GΩ | −103 | −0.35% | −0.5% |
| 22 | 20 μm | 100 GΩ | −305 | −0.3% | −0.6% |

TABLE 6-continued

| Sample | Thickness | Area resistance value | Temperature characteristic of resistance value (TCR) (PPm/° C.) | $10^{-7}$ Torr 70° C. 30 kV: change in area resistance value after 5000 hrs. | 45 kV: change in area resistance value after 10 hrs. |
|---|---|---|---|---|---|
| 23 | 20 μm | 5 GΩ | +105 | −0.5% | −0.8% |
| 24 | 20 μm | 10 GΩ | +10 | −0.2% | −0.7% |
| 25 | 20 μm | 15 GΩ | +10 | 0.3% | −1.0% |
| 26 | 20 μm | 150 GΩ | −1500 | −0.8% | −1.2% |
| 27 | 20 μm | 18 GΩ | −150 | −0.3% | −1.0% |
| 28 | 20 μm | 52 GΩ | −450 | −0.5% | −1.5% |
| 29 | 20 μm | 30 GΩ | −520 | −0.7% | −1.3% |
| 30 | 20 μm | 180 GΩ | −1550 | −0.8% | −1.2% |
| 31 | 20 μm | 205 GΩ | −1630 | −0.9% | −1.2% |

It is appreciated from Tables 1 through 6 that compared to a conventional $RuO_2$-glass-based resistor, a conventional ceramic resistor, or a conventional cermet resistor including Mo (molybdenum) or W (tungsten) and an insulating oxide, the resistors including both or either of a metal conductive oxide or a transition metal material, and an insulating oxide have a higher area resistance value, exhibit a smaller change in the TCR, and change less in the area resistance value against a load at an area identical resistance value (i.e., have a higher durability against application of a high voltage).

When a high load of about 45 kV is applied, the conventional resistors are significantly damaged since the TCR is negative.

As described above, a resistor according to the present invention is formed of a mixture of both or either of a metal conductive oxide or a transition metal material, and an insulating oxide, and is formed on alumina or glass by a plasma flame-spraying method or a laser flame-spraying method. Such a resistor has a sufficiently high area resistance value and is obtained without a baking process.

Since the particles of the metal conductive oxide or the transition metal material are dispersed among the particles of the insulating oxide, the resistor formed of the above-described mixture has a sufficiently high area resistance value.

The resistor according to the present invention is stable due to a superior load characteristic in vacuum and a small TCR.

The metal conductive oxides usable in the resistor include, for example, titaniumoxide, rhenium oxide, iridium oxide, ruthenium oxide, vanadium oxide, rhodium oxide, osmium oxide, lanthanum titanate, $SrRuO_3$, molybdenum oxide, tungsten oxide, and niobium oxide. These oxides can be used independently or in combination of two or more.

Preferably, TiO, $ReO_3$, $IrO_2$, $RuO_2$, VO, $RhO_2$, $OSO_2$, $LaTiO_3$, $SrRuO_3$, $MoO_2$, $WO_2$, and NbO are used.

The transition metal materials usable in the resistor include, for example, titanium, rhenium, vanadium niobium. These materials can be used independently or in combination of two or more.

The insulating oxides usable in the resistor include, for example, alumina, silicon oxide, zirconium oxide, and magnesium oxide. These materials can be used independently or in combination of two or more.

Preferably, $Al_2O_3$, $SiO_2$, $ZrO_2$, and MgO are used.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A field emission display, comprising:

an anode;

a cathode; and a resistor provided between the anode and the cathode, wherein:

the resistor includes a mixture of at least one of a metal conductive oxide and a transition metal material with an insulating oxide, the resistor is formed using a flame-spraying method, and the resistor has an area resistance value of at least about 1 GΩ/□.

2. The field emission display according to claim 1, further comprising a support provided between the anode and the cathode, wherein the support is covered with the resistor.

3. The field emission display according to claim 2, wherein the support includes at least one of glass and alumina.

4. The field emission display according to claim 1, wherein the metal conductive oxide is at least one material selected from the group consisting of titanium oxide, rhenium oxide, iridium oxide, ruthenium oxide, vanadium oxide, rhodium oxide, osmium oxide, lanthanum titanate, $SrRuO_3$, molybdenum oxide, tungsten oxide, and niobium oxide.

5. The field emission display according to claim 1, wherein the metal conductive oxide is at least one material selected from the group consisting of TiO, $ReO_3$, $IrO_2$, $RuO_2$, VO, $RhO_2$, $OsO_2$, $LaTiO_3$, $SrRuO_3$, $MoO_2$, $WO_2$, and NbO.

6. The field emission display according to claim 1, wherein the transition metal material is at least one material selected from the group consisting of titanium, rhenium, vanadium, and niobium.

7. The field emission display according to claim 1, wherein the insulating oxide is at least one material selected from the group consisting of alumina, silicon oxide, zirconium oxide, and magnesium oxide.

8. The field emission display according to claim 1, wherein the insulating oxide is at least one material selected from the group consisting of $Al_2O_3$, $SiO_2$, $ZrO_2$, and MgO.

9. The field emission display according to claim 1, wherein the metal conductive oxide is TiO, and the insulating oxide is $Al_2O_3$.

* * * * *

UNITED STATES PATENT AND TRADEMARK OFFICE

CERTIFICATE OF CORRECTION

PATENT NO. : 6,495,966 B2 
DATED : December 17, 2002
INVENTOR(S) : Aoki et al.

It is certified that error appears in the above-identified patent and that said Letters Patent is hereby corrected as shown below:

Title page,
Item [56], References Cited, FOREIGN PATENT DOCUMENTS, insert:

| | | | |
|---|---|---|---|
| -- | GB | 09204109 | 08/1981 |
| | JP | 99117578.5 | 08/1997 |
| | GB | 1595061 | 08/1981 -- |

Signed and Sealed this

Twelfth Day of August, 2003

JAMES E. ROGAN
*Director of the United States Patent and Trademark Office*